US005328167A

United States Patent [19]

Frank

[11] Patent Number: 5,328,167

[45] Date of Patent: Jul. 12, 1994

[54] SHEET FEED APPARATUS

[75] Inventor: Nicholas Frank, London, United Kingdom

[73] Assignee: Xerox Corporation, Stamford, Conn.

[21] Appl. No.: 940,139

[22] Filed: Sep. 3, 1992

[30] Foreign Application Priority Data

Sep. 11, 1991 [GB] United Kingdom ..... 9119479

[51] Int. Cl.[5] ..... B65H 9/12

[52] U.S. Cl. ..... 271/241; 271/147

[58] Field of Search ..... 271/240, 248, 250, 145, 271/147, 241

[56] References Cited

U.S. PATENT DOCUMENTS

| | | | |
|---|---|---|---|
| 4,307,878 | 12/1981 | Kono | 271/22 |
| 4,358,102 | 11/1982 | Hoshizaki et al. | 271/170 |
| 4,362,297 | 12/1982 | Landa | 271/152 |
| 4,418,903 | 12/1983 | Landa | 271/10 |
| 4,637,601 | 1/1987 | Costa et al. | 271/160 |
| 4,726,698 | 2/1988 | Weiss et al. | 400/629 |

FOREIGN PATENT DOCUMENTS

| | | | |
|---|---|---|---|
| 203045 | 9/1986 | Japan | 271/145 |
| 3138224 | 6/1991 | Japan | 271/241 |
| 327920 | 12/1991 | Japan | 271/241 |
| 2053159 | 2/1981 | United Kingdom . | |

*Primary Examiner*—David H. Bollinger
*Attorney, Agent, or Firm*—Kevin R. Kepner

[57] ABSTRACT

A sheet feeding apparatus includes a sheet stack container comprising opposed vertical walls between which sheets are stacked and a sheet feeder for feeding sheets off the top of the stack in a direction between the walls and parallel with the walls. The container includes a platform for elevating the stack into contact with the sheet feeder, and pusher members in one of the walls for urging the stack against the other wall. The pusher members are positioned at or near the top of the stack, and act only on a minor proportion of the stack height when the maximum stack height is contained in the container. First and second pusher members are provided, the first pusher member being urged towards the stack by a relatively strong spring, and acting on sheets near the top of the stack, but not on the sheets nearest the top of the stack, and the second pusher member being urged towards the stack by a relatively light spring, and acting on the sheets nearest the top of the stack. The platform pushes the first pusher member away from the stack when the stack is almost depleted to prevent buckling of the stack.

10 Claims, 3 Drawing Sheets

SHEET FEED APPARATUS

This invention relates generally to a sheet feed apparatus, and more particularly concerns a high capacity sheet feeder for an electrophotographic printing machine.

Where sheets are arranged in a stack it is conventional to feed them one at a time from the stack using a roller feed arrangement located in the feedhead of the apparatus. The sheets are stacked on a stack support, for example an elevating tray, movable between a lower, sheet loading, position in which sheets can be loaded on or unloaded from the tray, and an upper, sheet feeding, position in which the topmost sheet in the stack engages the feedhead so that sheets can be fed from the tray. It is difficult to feed the sheets one at a time since there is a tendency for sheets to feed together due to frictional forces between them. In order to alleviate this problem it is well known to use an arrangement of the kind known as a retard feeder in which the sheets are advanced into the nip between a driven sheet advancing member, suitably a roller, and a stationary friction member known as a retard member, which coact such that a first sheet in contact with the sheet advancing member is advanced through the nip by driving the advancing member, other sheets in the nip area being retarded by the stationary retard member.

The tray which contains the sheets conventionally has a movable base which may be spring-urged upwards to bring the top of the stack up into feeding engagement with the feed roller, or, in the case of a high capacity tray, the base may be driven upwards by a motor, the motor making incremental movements as the sheets are fed out of the tray. For reliable operation of the machine into which the sheets are fed, each sheet must be correctly positioned in both the process direction and laterally of the process direction. The positioning and the speed and timing of operation of the feed roller enables correct positioning in the process direction, and lateral positioning is achieved by arranging for the stack to be pushed towards a registration edge at one side of the sheet tray by one or more spring members on the opposite side of the tray from the registration edge.

In one known sheet tray for an electrophotographic printing machine, a first lateral pusher member, with a stronger spring, extends from the bottom of the stack almost to the top so as to push the whole stack towards the registration edge. A second pusher member, overlapping with the first pusher member and having a lighter spring, gently pushes the topmost portion of the stack towards the registration edge. This arrangement prevents the stronger spring of the first pusher member from buckling the stack when only a few sheets remain in the tray. On loading a stack of sheets into a tray of this kind, the first pusher member is pushed out of the way by the stack of sheets being held and manipulated by the machine operator and then pushes the stack into its registered position when the stack is released by the operator. The use of pusher members of this kind is desirable because of the tolerances encountered in the manufacture of the tray itself and in the actual sizes of the cut sheets. The total tolerance can be as much as 5 mm over the width of a standard paper tray in an electrophotographic printing machine.

The known arrangement just described, while suitable for a tray containing up to about 500 sheets, is not suitable for a high capacity sheet feeder, which may contain 2000 or more sheets. The problem arises that the spring of the main pusher member would need to be extremely strong for it to be able to register the whole stack, making it difficult or impossible to load the stack without damaging the sheets being loaded.

In accordance with one aspect of the present invention, there is provided a sheet feeding apparatus. The apparatus comprises means for supporting a stack of sheets and a registration edge. Means for advancing outermost sheets from the stack thereof and means for applying a force on the stack of sheets to urge the stack of sheets against the registration edge are provided. Means, responsive to the stack of sheets being of a preselected thickness, for reducing the force exerted by the applying means on the stack of sheets to prevent buckling thereof is further provided.

A sheet feed apparatus in accordance with the invention will now be described, by way of example, with reference to the accompanying drawings, in which.

Figure 2:
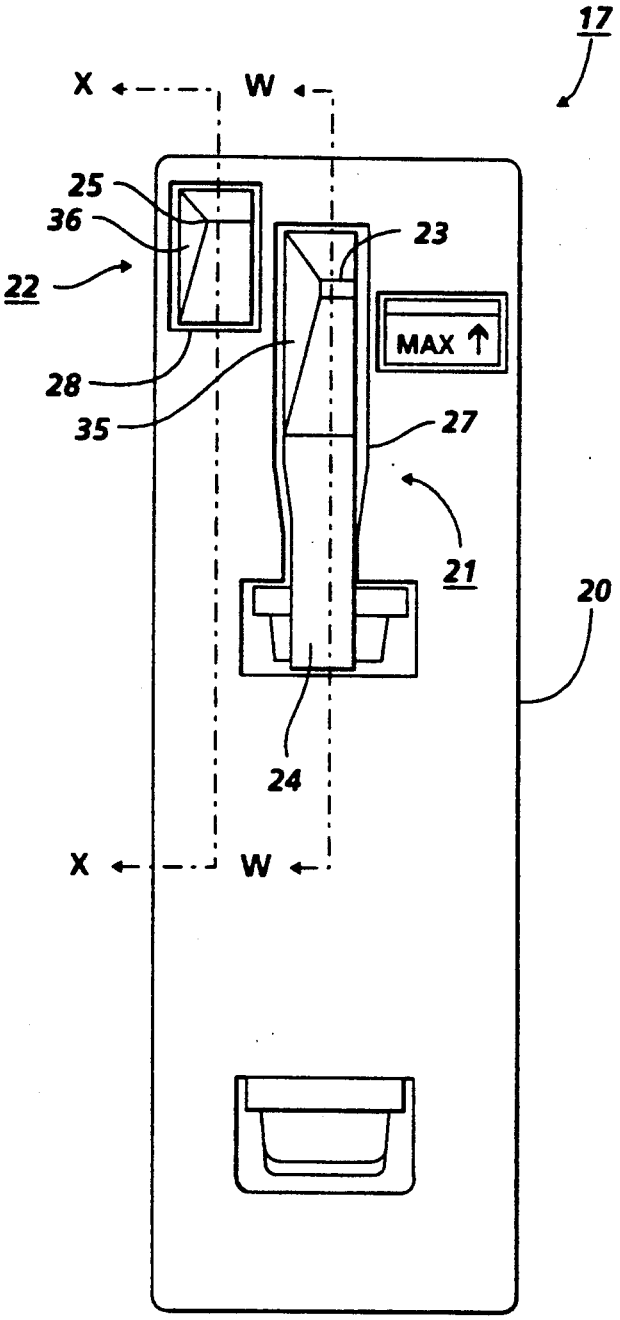
FIG. 2 is a front elevational view of part of the FIG. 1 sheet feeder.
Figure 4A:
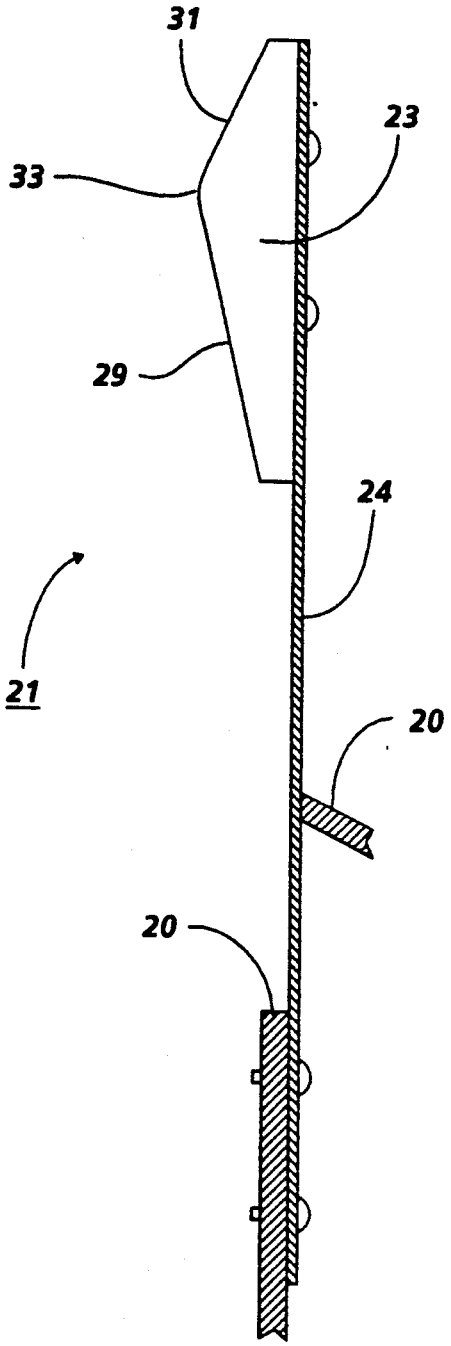
Figure 4B:
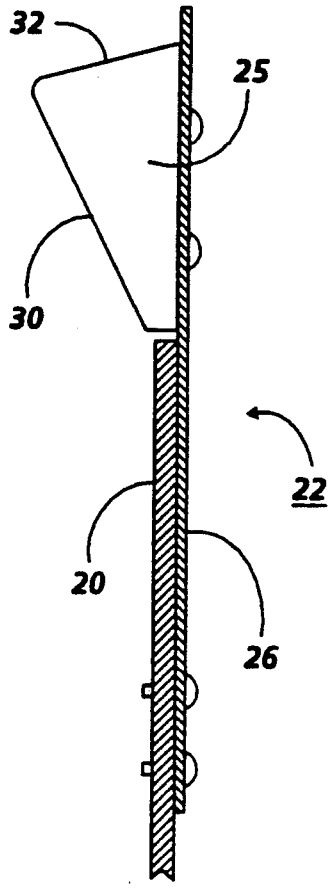

FIG. 4*a* is a sectional view taken along the line in the direction of arrows W—W of FIG. 2; and FIG. 4*b* is a sectional view taken along the line in the direction of arrows X—X of FIG. 2.

Figure 1:
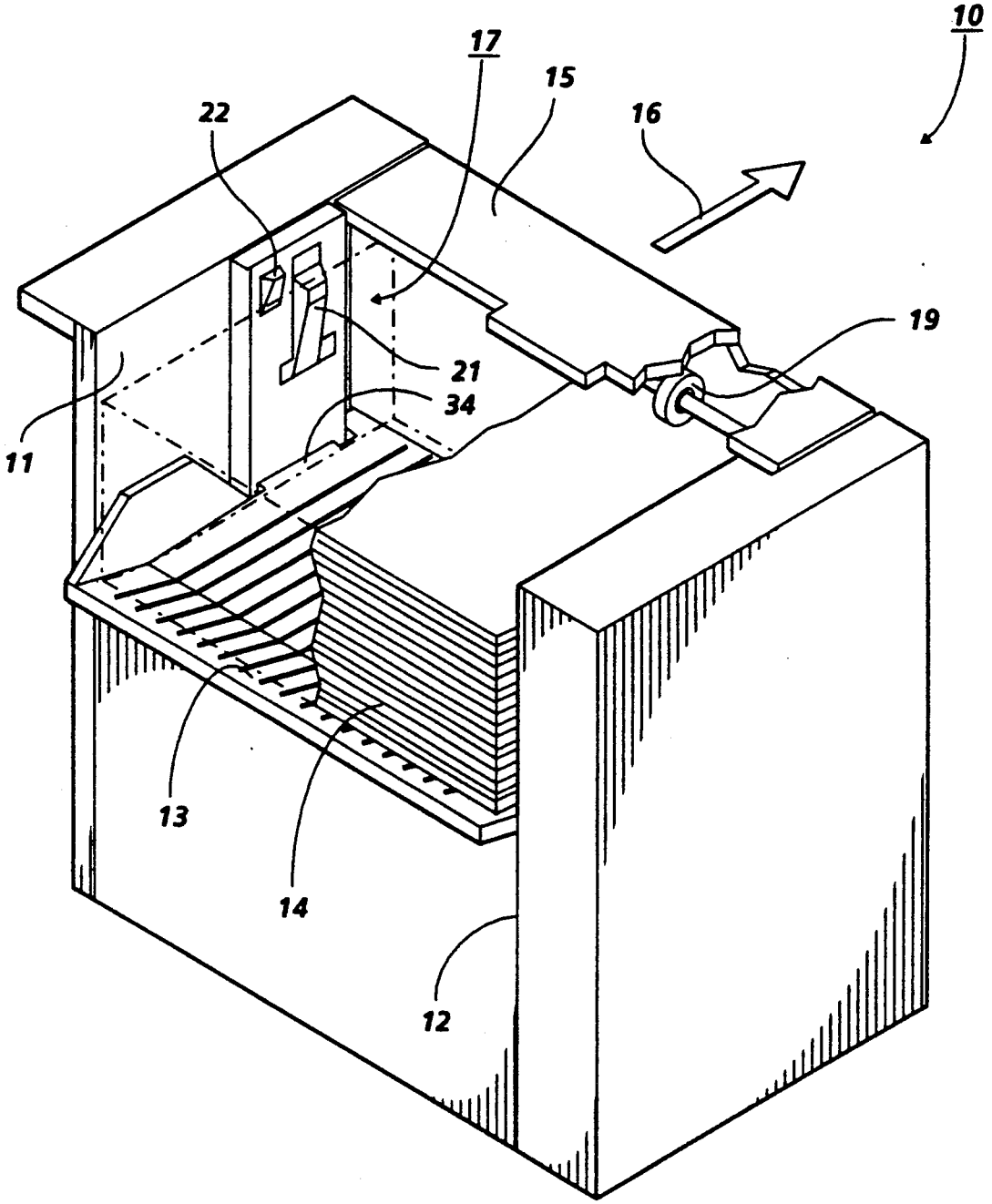
FIG. 1 is a perspective view of a high capacity sheet feeder of the type used to supply sheets to an electrophotographic printer.

Referring to FIG. 1, a sheet feeding apparatus 10 includes a sheet stack container which comprises vertical walls 11 and 12, and an elevating tray base 13. A stack of sheets 14 is loaded onto the base 13, which then raises the stack until the top sheet engages a feed roller 19 mounted on the underside of a feedhead 15. The feedhead 15 is pivotally mounted in walls 11 and 12 so that the feed roller rests under the weight of the feedhead on the top sheet in the stack. On rotation of the feed roller, the top sheet is fed out of the container in the direction indicated by arrow 16, i.e. generally horizontally in a direction parallel with the walls 11 and 12. The fed sheet is then received by sheet feeding devices in a machine (not shown) in which the sheet feeder 10 is located, or to which it is attached. The machine which receives the fed sheet may be any well known kind of printer or copier, such as a xerographic printer or copier.

When it is desired to load the container, the base 13 is lowered to the bottom of walls 11 and 12, for example in response to the opening of a cover or door of the container. The stack is maneuvered into position on the base 13, the dimensions of the container being such that the stack is a loose fit between the walls 11 and 12. Once the stack has been properly loaded, and moved as far as it will go in the container in the direction of arrow 16, the base 13 may be raised using a motor (not shown) in well known fashion so as to bring the top of the stack into engagement with the feed roller beneath the feedhead 15. As the stack approaches the feedhead 15, its rearward edge (as viewed in FIG. 1) encounters a pusher assembly 17 which will now be described in more detail below. Two pusher members in the pusher assembly 17 urge the topmost part of the stack towards the front of the container as viewed in FIG. 1, thereby registering the topmost sheets against a registration edge provided by the front wall 12.

Figure 3:
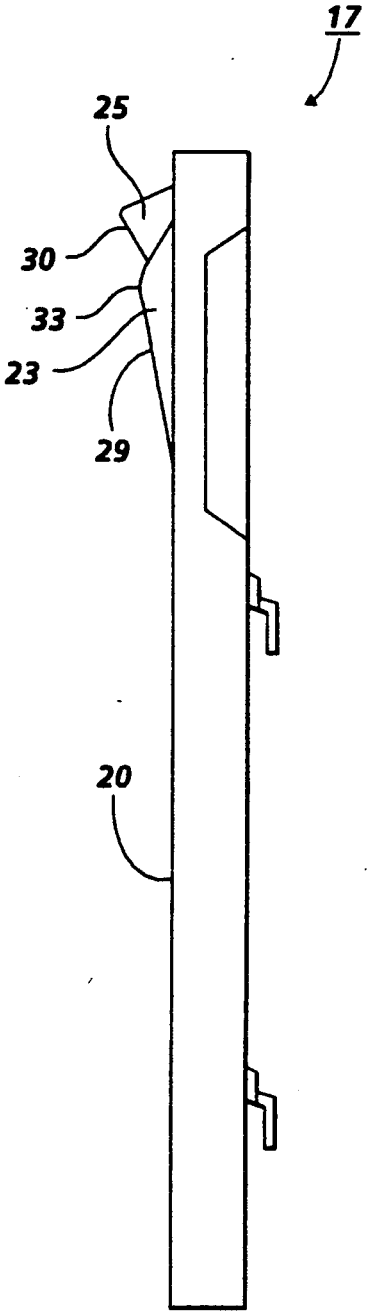
FIG. 3 is a side elevational view of the pusher assembly of the FIG. 1 sheet feeder.

Referring now to FIGS. 2 through 4 inclusive, the pusher assembly comprises a housing 20, and first and second pusher members 21 and 22. The housing 20, which is of generally box-like configuration, is mounted on rear wall 11, and has both pusher members 21 and 22 secured to it near the top of the wall 11. The first, or main, pusher member 21 comprises a head 23, which may be of plastics material, and a spring strip 24, which may be of spring steel. The second pusher member 22, in similar fashion, consists of a head 25 and a spring strip 26. The spring strip 24 of the first pusher member 21 has a strong spring rate, whereas the spring strip 26 of the second pusher member 22 has a lighter spring rate. The lower end of the strip spring of each pusher member is secured to the inside of the front wall of housing 20. The head 23 of the first pusher member 21 protrudes through a first aperture 27 in the front wall of the housing 20, and the head 25 of the second pusher member 22 protrudes through a second aperture 28. The heads 23 and 25 of the first and second pusher members have lower ramped surfaces 29 and 30 respectively, which taper downwardly, and upper ramped surfaces 31 and 32 respectively, which taper upwardly. The upper ramped surface 31 of the head of the first pusher member is at the same height above the container base as the top part of the lower ramped surface 30 of the head of the second pusher member.

In operation of the apparatus, the base 13 carrying a stack of sheets is raised. As the stack moves up, its topmost sheets first encounter the lower ramped surface 29 of the first pusher member 21. The spring force of the first pusher member registers the topmost sheets against front wall 12. As the stack continues to rise, the topmost sheets pass the widest part 33 of the head 23 and come level with the upper ramped surface 31 of the first pusher member. Above this point, the topmost sheets are no longer pushed by the first pusher member, but encounter the lower ramped surface 30 of the second pusher member, which gently pushes the topmost sheets towards the front wall 12, thereby registering the sheets without buckling them. Finally, the top of the stack arrives at the sheet feed position, with the topmost sheet in engagement with the feed roller in feedhead 15.

As the sheets are fed off the stack one by one, the stack height diminishes until the bottom of the stack comes up level with the bottom of the lower ramped surface 29 of the head of the first pusher member. At this point, a cam surface 34 (FIG. 1) on the edge of the base 13 engages the lower ramped surface 29 of the first pusher member, and gradually pushes back the pusher member so that it exerts less and less force on the remaining sheets. This prevents the strong spring of the first pusher member from buckling the sheets when only a relatively small number of sheets remain in the container.

Incorporation of the present invention into a high capacity sheet feeder enables a large stack of paper sheets to be loaded without difficulty, while still achieving good registration. In order to further assist in the loading of the container to maximum capacity, the edges of the heads of the pusher members facing the stack as it is introduced into the container may be chamfered, as can be seen in FIG. 2 at 35, 36, so that the heads are partially pyramidal in shape.

What is claimed is:

1. A sheet feeding apparatus, comprising:
means for supporting a stack of sheets;
a registration edge;
means for advancing outermost sheets from the stack thereof;
means for applying a force on the stack of sheets to urge the stack of sheets against said registration edge, said force applying means comprising a plurality of force applying elements; and
means, responsive to the stack of sheets being of a preselected thickness, for reducing the force exerted by said applying means on the stack of sheets to prevent buckling thereof by disengaging at least one of said force applying elements.

2. The apparatus according to claim 1, wherein said applying means comprises means for resiliently urging the stack of sheets against said registration edge.

3. A sheet feeding apparatus, comprising:
means for supporting a stack of sheets;
a registration edge;
means for advancing outermost sheets from the stack thereof;
means for applying a force on the stack of sheets to urge the stack of sheets against said registration edge, said applying means comprising means for resiliently urging the stack of sheets against said registration edge, said urging means comprising first resilient means adapted to engage a portion of the stack and second resilient means adapted to engage at least a portion of the stack having a preselected thickness, said first resilient means adapted to engage at least a portion of the stack other than the portion having the preselected thickness; and
means, responsive to the stack of sheets being of the preselected thickness, for reducing the force exerted by said first resilient means on the stack of sheets to prevent buckling thereof, said reducing means spacing said first resilient means from the stack in response to the stack being of the preselected thickness.

4. The apparatus according to claim 3, wherein said supporting means comprises:
a tray adapted to support the stack of sheets; and
means for moving said tray toward said advancing means to maintain successive outermost sheets in contact with said advancing means.

5. The apparatus according to claim 4, wherein said reducing means comprises a cam mounted on said tray and adapted to move in unison therewith, said cam spacing said second resilient means from the stack in response to the stack being of the preselected thickness.

6. The apparatus according to claim 5, wherein:
said first resilient means comprises a first pusher, and first means for resiliently urging said first pusher against the stack; and
second resilient means comprises a second pusher, and second means for resiliently urging said second pusher against the stack, said cam engaging said first pusher to space said first pusher from the stack as said tray moves the stack of sheets toward said advancing means with the stack being of the preselected thickness.

7. The apparatus according to claim 6, wherein said first urging means applies a greater force on the stack than said second urging means.

8. The apparatus according to claim 7, wherein said first pusher comprises a downwardly tapered surface adjacent the sheet stack so that the force on the stack increases as the stack moves in an upwardly direction.

9. The apparatus according to claim 8, wherein said second pusher comprises a downwardly tapered surface adjacent to the sheet stack so that the force on the stack increases as the stack moves in an upwardly direction.

10. The apparatus according to claim 9, wherein said first pusher comprises an upwardly tapered surface above said downwardly tapered surface with the upwardly tapered surface overlapping the downwardly tapered surface of said second pusher.

* * * * *